US010283899B2

(12) United States Patent
Qi

(10) Patent No.: US 10,283,899 B2
(45) Date of Patent: May 7, 2019

(54) CABLE HEADER

(71) Applicant: Cisco Technology, Inc., San Jose, CA (US)

(72) Inventor: Wei Qi, Shanghai (CN)

(73) Assignee: CISCO TECHNOLOGY, INC., San Jose, CA (US)

( * ) Notice: Subject to any disclaimer, the term of this patent is extended or adjusted under 35 U.S.C. 154(b) by 271 days.

(21) Appl. No.: 15/289,722

(22) Filed: Oct. 10, 2016

(65) Prior Publication Data

US 2018/0102610 A1 Apr. 12, 2018

(51) Int. Cl.
*H01R 13/514* (2006.01)

(52) U.S. Cl.
CPC ..... *H01R 13/514* (2013.01)

(58) Field of Classification Search
None
See application file for complete search history.

(56) References Cited

U.S. PATENT DOCUMENTS

2010/0062629 A1* 3/2010 Feldman ..... G01R 31/2889 439/219

* cited by examiner

*Primary Examiner* — Dimary S Lopez Cruz
(74) *Attorney, Agent, or Firm* — Polsinelli PC

(57) ABSTRACT

Disclosed are apparatuses including a cable header block with apertures for floating inserts and a cover plate. The cable header block includes an aperture pattern that matches a pattern of connector terminals. The floating inserts fit in the apertures of the cable header block. The cover plate can also include a through-hole pattern that matches the aperture pattern. Also, each of the through-holes can include a first geometric shape larger than a cross-section of a cable terminal end and a second geometric shape adjacent to the first shape that is smaller than the cross-section of the cable terminal end. The cover plate retains the floating inserts within the apertures. Also, the cover plate aligns the first geometric shape over the floating inserts when the fastener is in a first position and aligns the second geometric shape over the floating inserts when the fastener is in a second position.

20 Claims, 10 Drawing Sheets

CABLE HEADER

TECHNICAL FIELD

The present technology pertains to a cable header; more specifically, the present technology relates to a cable header that facilitate alignment of cable terminals with connector terminals and that allows the cables to be easily removed without special tools.

BACKGROUND

Cable headers are often used to house a collection of cable terminals for coupling with connector terminals of an electronic component. However, the collection of parts that make up the connector terminals of the electronic component, the cable terminals, an electronic component itself, etc. can all be manufactured with design tolerances. The tolerances can stack and create misalignment possibilities between the cable terminal ends and the connector terminals of the electronic component. Additionally, traditional cable headers require removing the component-facing side of the cable header and using a special cable removal tool to remove the cable terminals from the cable header. Therefore, there is a need in the art for a cable header that alleviates potential misalignment issues and that allows removal of the cable terminals from the back side of the cable header without the need for specialized tools.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DESCRIPTION OF EXAMPLE EMBODIMENTS

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Overview

Disclosed are apparatuses including a cable header block with apertures for floating inserts and a cover plate. The cable header block can include a fastener hole and an aperture pattern of a plurality of apertures. The aperture pattern can substantially match a pattern of connector terminals on an electronic component. The floating inserts fit in one of the apertures of the cable header block and can be sized such that a gap exists between the floating inserts and the apertures. The cover plate can include a substantially flat surface with a slide channel disposed along a linear length through the surface of the cover plate. The cover plate can also include a through-hole pattern that substantially matches the aperture pattern. Also, each of the through-holes can include a first geometric shape larger than a cross-section of a cable terminal end and a second geometric shape adjacent to the first shape that is smaller than the cross-section of the cable terminal end. The cover plate retains the floating inserts within the one or more apertures. Also, the cover plate aligns the first geometric shape over the floating inserts when the fastener is in a first position in the slide channel and aligns the second geometric shape over the floating inserts when the fastener is in a second position in the slide channel.

Example Embodiments

Figure 1A:
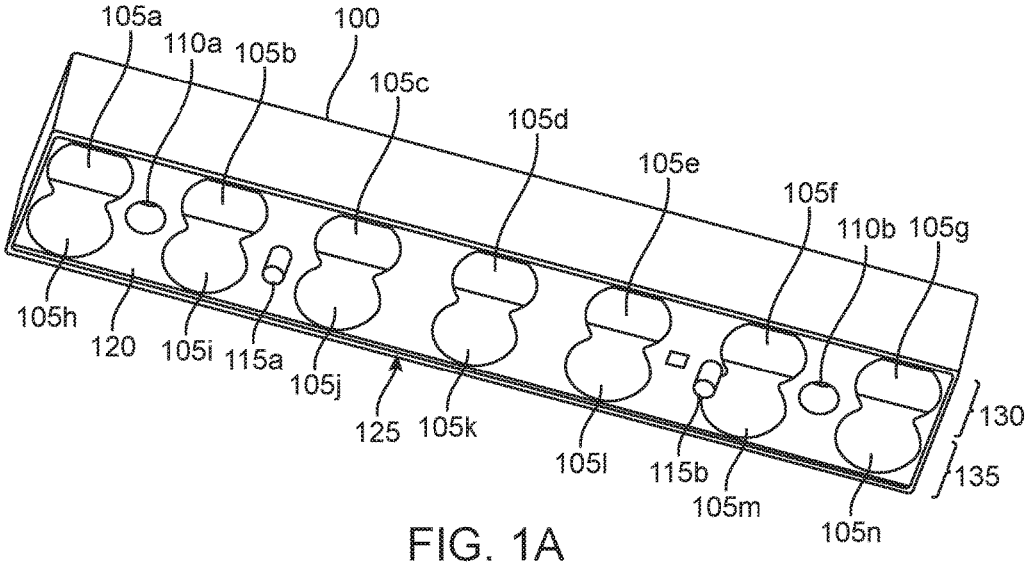
FIG. 1A illustrates a cable header block.

The present technology involves a cable header apparatus with floating inserts to facilitate alignment between a panel connector and a cable connector and with a cover plate that slides to alternatively lock and unlock cables inserted into the float inserts from being able to be removed. FIG. 1A illustrates a cable header block 100. The cable header block 100 can be used to house cable terminal ends that are grouped together for coupling with the connector terminals of an electronic component, such as a switch. The cable header block 100 includes a plurality of apertures 105*a*-105*n*, fastener holes 110*a*, 110*b*, and guide pins 115*a*, 115*b*. A top surface 120 of the cable header block 100 can be recessed and a surface ridge 125 follow an upper top surface perimeter of the cable header block 100.

Figure 1B:
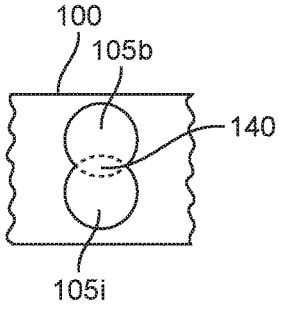
FIG. 1B illustrates a top view of a section of a cable header block with an aperture overlapping another aperture.

The apertures 105*a*-105*n* are disposed in an aperture pattern that can substantially match a pattern of connector terminals on an electronic component. For example, the aperture pattern in FIG. 1A includes a top row of apertures 130 and a bottom row of apertures 135. A portion of the aperture boundary for the apertures in the top row 130 overlap with a portion of the aperture boundary for the apertures in the bottom row of apertures 135, thereby defining an overlap region. FIG. 1B illustrates a top view of a section of a cable header block 100 with an aperture 105*b* overlapping another aperture 105*i* and forming an overlap region 140.

The cable header apparatus can include floating inserts that can be fit into the apertures 105*a*-105*n* of the cable header block 100. The floating inserts can also be selected with dimensions smaller than the apertures 105*a*-105*n* such that a gap is formed between a portion of the dimension of the floating insets and the apertures 105*a*-105*n*, thereby allowing the floating inserts to "float" in the apertures 105*a*-105*n* (as shown in greater detail in FIG. 4). As explained above, a collection of parts that make up the connector terminals of the electronic component, the cable terminals, an electronic component itself, etc. can all be manufactured with design tolerances. The tolerances can stack and create misalignment possibilities between the cable terminal ends and the connector terminals of the electronic component. However, the gap between a portion of the dimension of the floating insets and the apertures 105*a*-105*n* allows the floating inserts to displace to facilitate proper alignment despite the tolerance stack.

Figure 2:
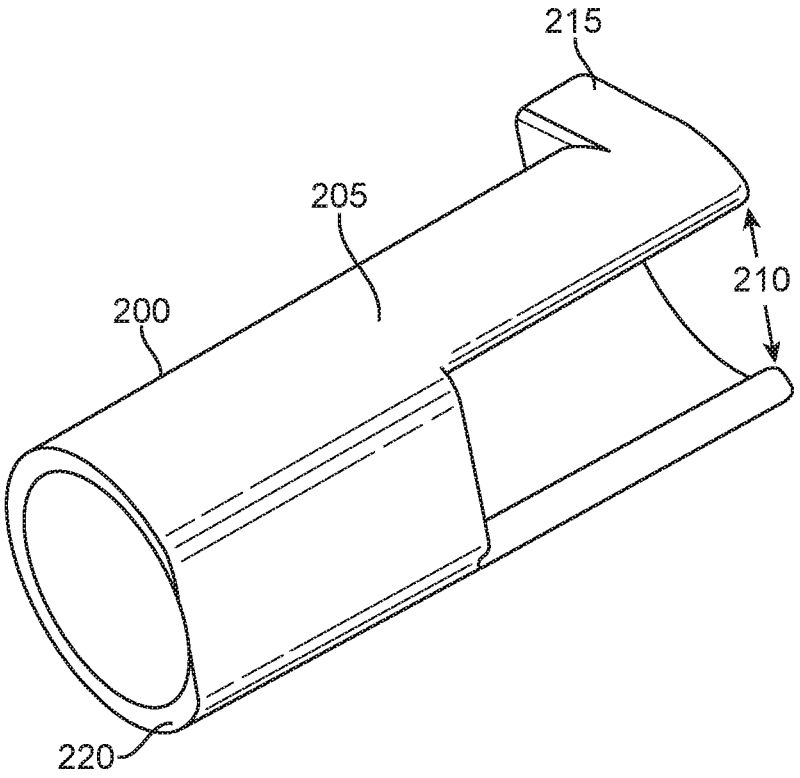
FIG. 2 illustrates a floating insert.

FIG. 2 illustrates a floating insert 200 that can fit into an aperture 105 of the cable header block 100. The floating insert 200 can have a substantially cylindrical outer surface 205, an alignment tab 215, and a cut-away section 210 on a terminal end of the floating insert 200. The cross-sectional shape of the cut-away section 210 can be substantially similar to the portion of the aperture boundaries in the overlap region 140. The floating insert 200 can also have a chamfered edge 220 on another terminal end that further facilitates alignment with connector terminals on an electronic component.

Figure 3A:
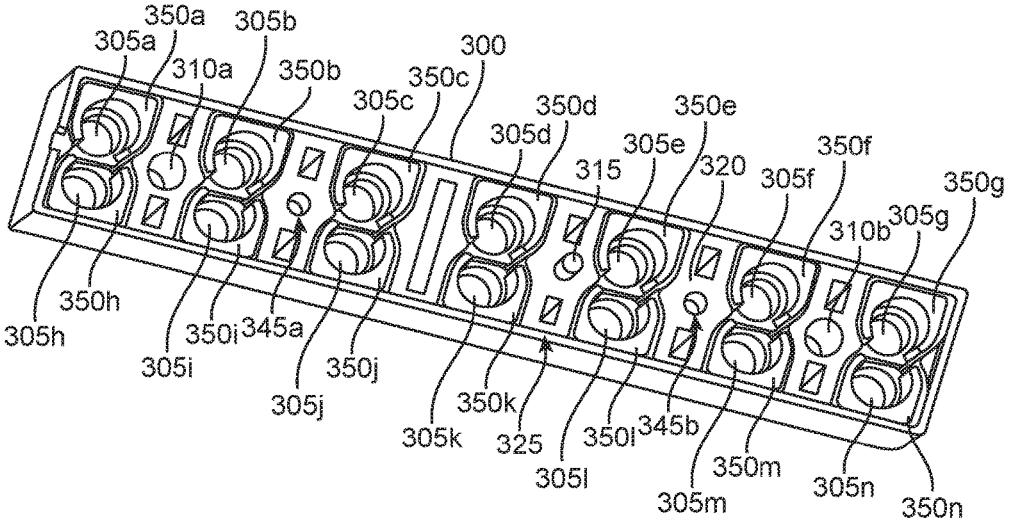
FIG. 3A illustrates the cable header block with floating inserts inserted into the apertures.

FIG. 3A illustrates the cable header block 300 with a plurality of floating inserts 350*a*-350*n* inserted into the plurality of apertures 305*a*-305*n*. The cable header block 300 further includes fastener holes 345*a*, 345*b*, guide pin 315, and backing plate screw coupling holes 310*a*, 310*b*. The top surface 320 of the cable header block 300 can be recessed and a surface ridge 325 follow an upper top surface perimeter of the cable header block 300. Additionally, the cable header block 300 can further include insert recesses (occupied by floating inserts 350*a*-350*n*).

Figure 3B:
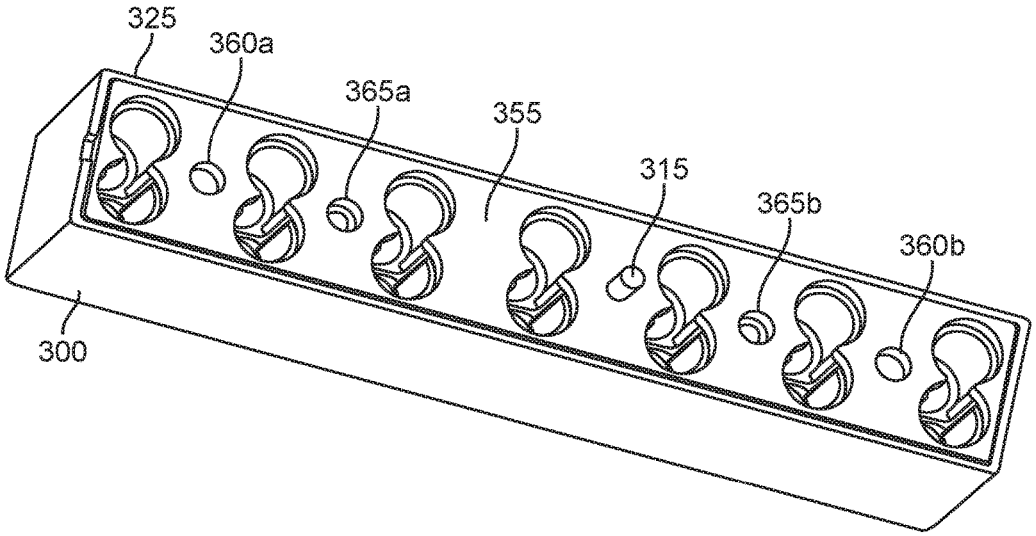
FIG. 3B illustrates the cable header block with a backing plate.

FIG. 3B illustrates the cable header block 300 with a backing plate 355 coupled onto the top surface 320 within the surface ridge 325 of the cable header block 300. The backing plate 355 includes a guide pin aperture (shown occupied by the guide pin 315), backing plate fastener holes 365*a*, 365*b* and guide plate lock screw apertures 360*a*, 360*b*.

Figure 3C:
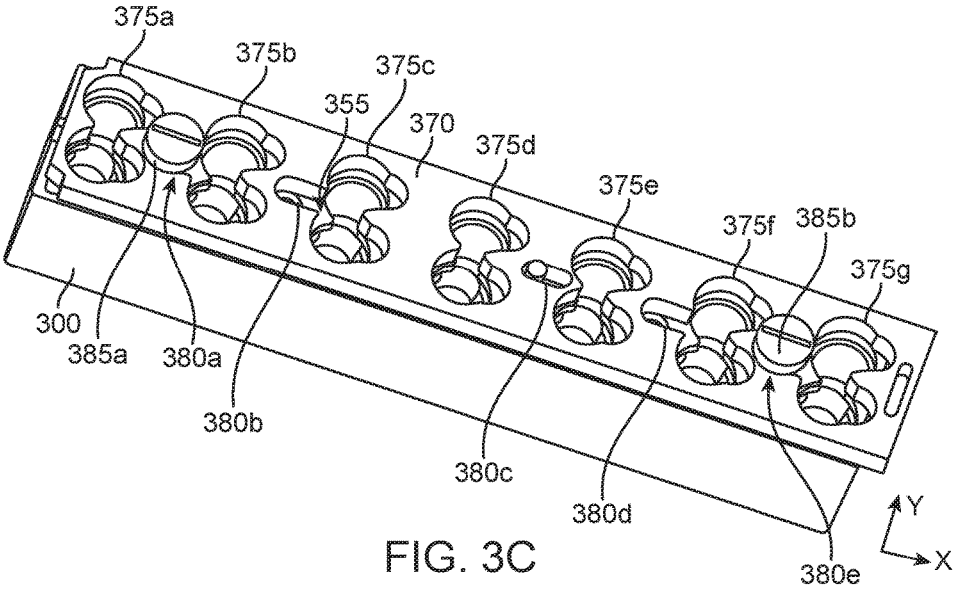
FIG. 3C illustrates the cable header block with a backing plate and a cover plate.
Figure 3D:
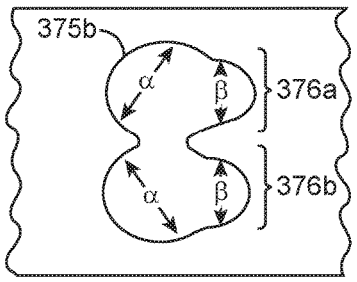
FIG. 3D illustrates a top view of a through-hole on a cover plate.
Figure 3E:
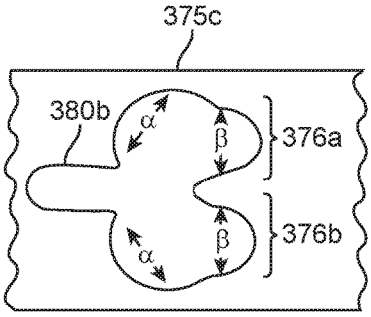
FIG. 3E illustrates a top view of a through-hole on a cover plate.

FIG. 3C illustrates the cable header block 300 with a backing plate 355 and a cover plate 370. The cover plate 370 includes a plurality of through-holes 375*a*-375*g* and slide channels 380*a*-380*e*. The through-holes 375*a*-375*g* are formed to substantially match the aperture pattern of the cable header block 300 and to include at least two geometric shapes. For example, FIGS. 3D and 3E illustrate a top view of through-hole 375*b* and 375*c*, respectively.

Through-hole 375*b* includes a top through-hole portion 376*a* and a bottom through-hole portion 376*b*. The top through-hole portion 376*a* has a first geometric shape α and the bottom through-hole portion 376*b* has a second geometric shape β. Likewise, FIG. 3E illustrates a top view of through-hole 375*c*, in which top through-hole portion 376*a* has a first geometric shape α and bottom through-hole portion 376*b* has a second geometric shape β. Additionally, through-hole 375*c* further includes a slide channel 380*b*.

Referring again to FIG. 3C, the cover plate 370 and backing plate 355 are coupled to the cable header block 300 with backing plate fasteners 385*a*, 385*b*. The backing plate fasteners 385*a*, 385*b* can be tightened to a degree that causes the cover plate 370 to secure the backing plate 355 against the top surface 320 of the cable header block 300 within the surface ridge 325 and that also allows the cover plate 370 to slide, as explained below. This degree of tightening secures the floating inserts 350*a*-350*n* in the cable header block 300.

Also, the backing plate fasteners 385*a*, 385*b* are disposed in the slide channels 380*a*, 380*e* and the guide pin 315 is disposed in slide channel 380*c*. Accordingly, the backing plate fasteners 385*a*, 385*b* can secure the cover plate 370 and backing plate 355 while still allowing the cover plate 370 to slide laterally in the +x and −x directions, as limited by the guide pin 315 in the slide channel 380*c*. Also, slide channel 380*b* and 380*d* are positioned over the fastener holes 345*a*, 345*b*, thereby allowing fasteners (not shown) to be inserted into the fastener holes 345*a*, 345*b*.

Figure 3F:
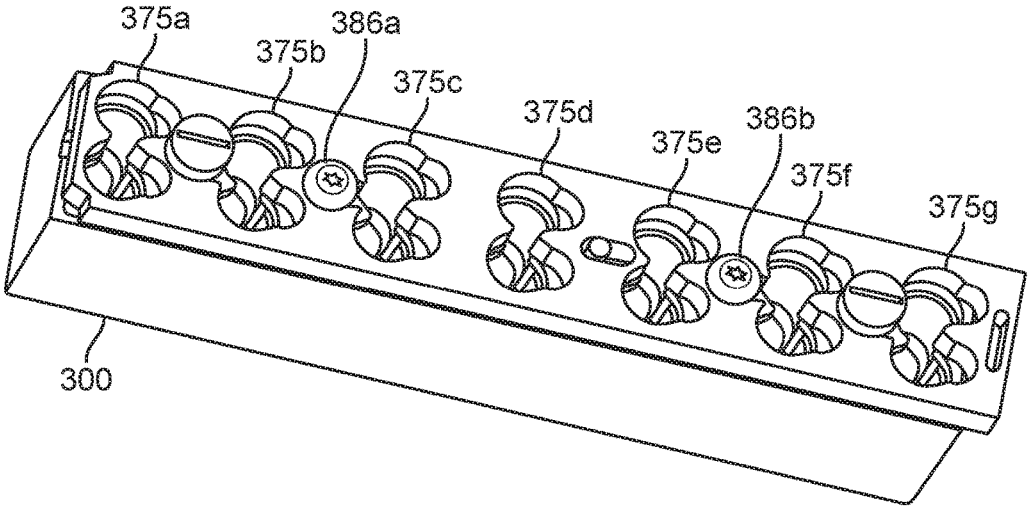
FIG. 3F illustrates the cable header block with fasteners in slide channels of the cover plate.

FIG. 3F illustrates the cable header block 300 with fasteners 386*a*, 386*b* in slide channels 380*a*, 380*b* of the cover plate 370. In some cases, the through-holes 375*a*-375*g* are configured to respectively position the first geometric shape α over the apertures 105*a*-105*n* when the when the fasteners 386*a*, 386*b* are in one position in the slide channels 380*b*, 380*d* and position the second geometric shape β over the apertures 105*a*-105*n* when the when the fastener are in second position in the slide channels 380*b*, 380*d*.

Figure 3G:
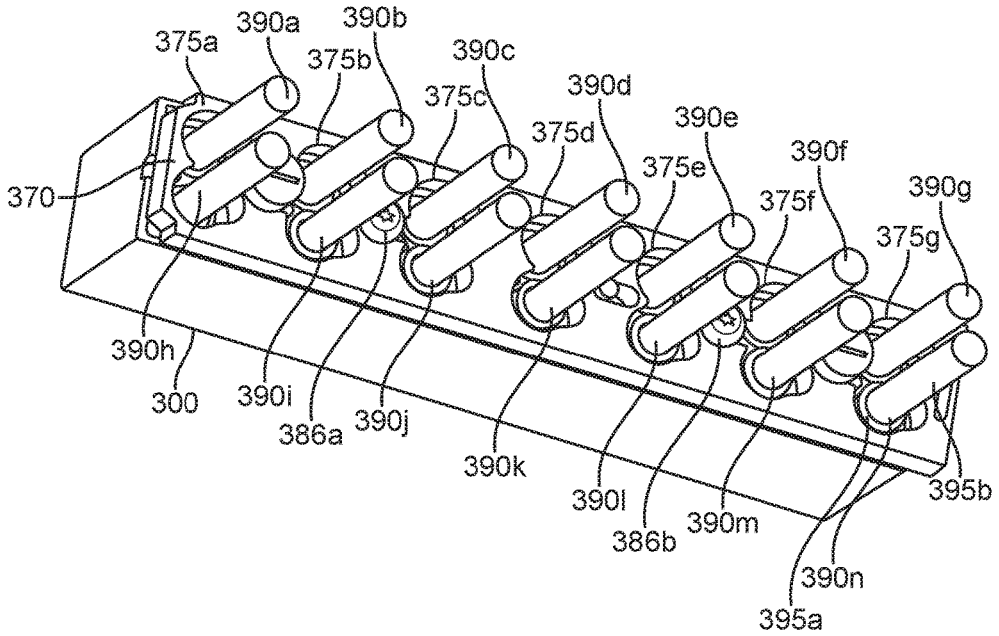
FIG. 3G illustrates the cable header block with a first geometric shape of the through-holes positioned over the apertures

Additionally, the first geometric shape α and the second geometric shape β can be selected based on the geometry of the cable terminals that are inserted into the cable header block 300. FIG. 3G illustrates the cable header block 300 with the fasteners 386*a*, 386*b* in a first terminal position in the slide channels 380*b*, 380*d*, resulting in the first geometric shape α of the through-holes 375*a*-375*g* being respectively positioned over the apertures 105*a*-105*n*. The first geometric shape α of the through-holes 375*a*-375*g* accommodates cable terminals 390*a*-390*n*. As labeled in reference to cable terminal 390*n*, the cable terminals 390*a*-390*n* can also include a wider bottom terminal end 395*a* and a narrower top lead 395*b*. As shown, the first geometric shape α can accommodate the wide bottom terminal end 395*a*. Also, the second geometric shape β of the through-holes 375*a*-375*g* can be less wide than the wide bottom terminal end 395*a*, but can accommodate the narrower top lead 395*b*.

Figure 3H:
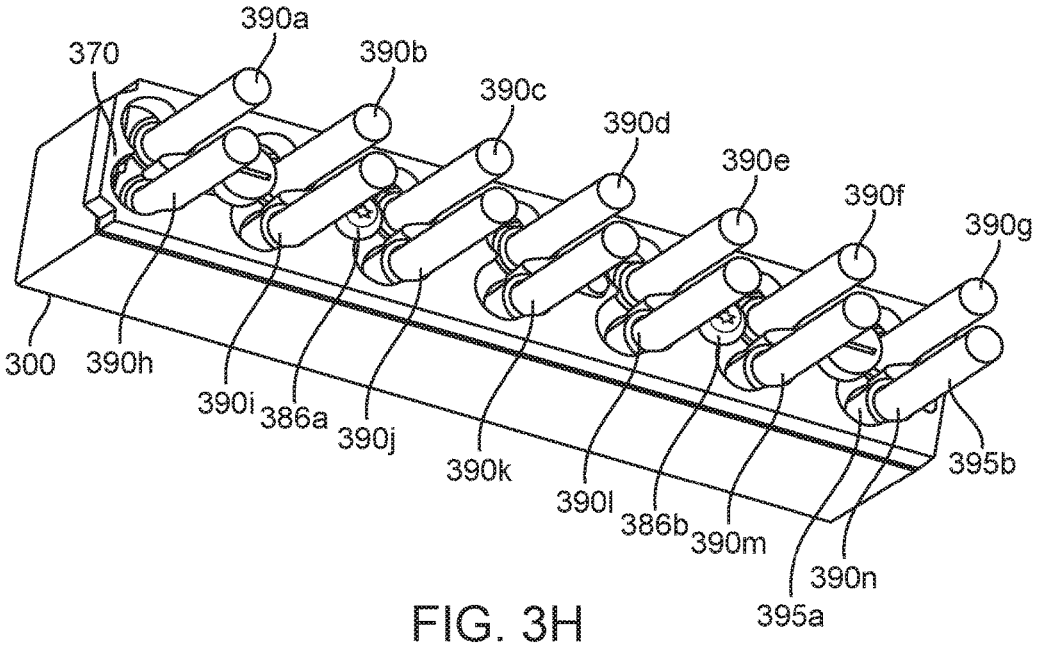
FIG. 3H illustrates the cable header block with a second geometric shape of the through-holes positioned over the apertures

FIG. 3H illustrates the cable header block 300 with the fasteners 386*a*, 386*b* in the second position in the slide channels 380*b*, 380*d*. When the cover plate 370 slides, such that the fasteners 386*a*, 386*b* are in the second position in the slide channels 380*b*, 380*d*, the second geometric shape β of the through-holes 375*a*-375*g* become respectively positioned over the apertures 105*a*-105*n*. Since the second geometric shape β of the through-holes 375*a*-375*g* are less wide than the wide bottom terminal end 395*a* of the cable terminals 390*a*-390*n*, the second geometric shape β of the through-holes 375*a*-375*g* effectively secure the cable terminals 390*a*-390*n* within the apertures 105*a*-105*n*. However, since the second geometric shape β of the through-holes 375*a*-375*g* can accommodate the narrower top lead 395*b*, the second geometric shape β of the through-holes 375*a*-375*g* does not interfere with the narrower top lead 395*b* of the cable terminals 390*a*-390*n*.

Also, when the cover plate 370 slides to the second position in the slide channels 380*b*, 380*d*, the fasteners 386*a*, 386*b* can be fastened within the fastener holes 345*a*, 345*b* and can lock the cable terminals 390*a*-390*n* within the apertures 305*a*-305*n*. However, the cable terminals 390*a*-390*n* can easily be removed by sliding the cover plate 370 back to the first position after loosening the fasteners 386*a*, 38*b* with a common tool.

Figure 4:
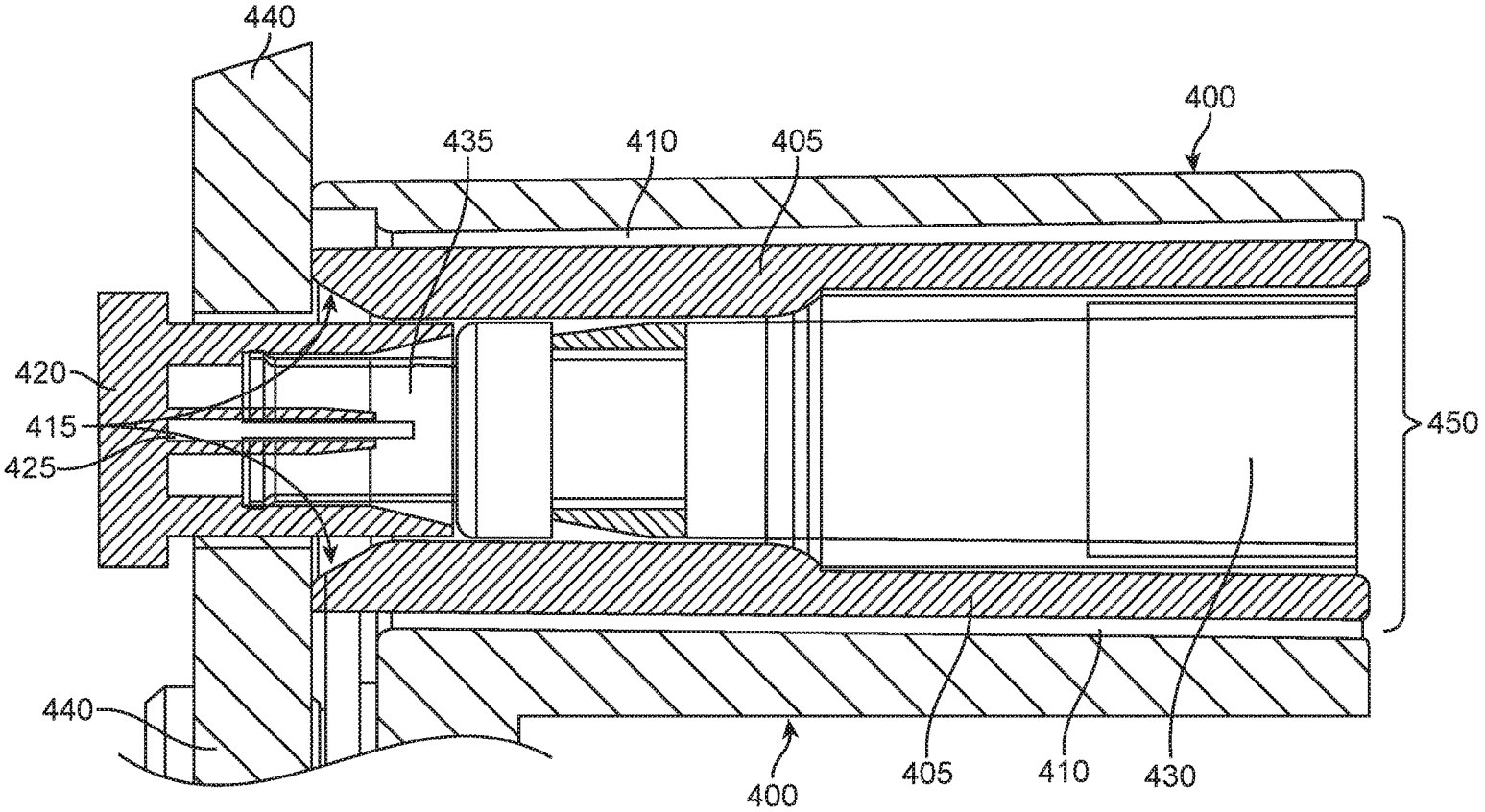
FIG. 4 illustrates a side view of a cable header block with a cable inserted into an aperture of the cable header block and coupled with a connector terminal on an electronic component panel.

FIG. 4 illustrates a side view of a cable header block 400 with a cable 430 inserted into an aperture 450 of the cable header block 400 and coupled with a connector terminal 420 on an electronic component panel 440. The cable 430 includes a cable terminal end 435 and cable pin 425 coupled with the connector terminal 420. As explained above, traditional cable headers can suffer from misalignment issues due to a tolerance stack. However, the cable header block 400 of FIG. 4 houses a float insert 405 within the aperture 450. The float insert 405 is smaller than the aperture 450, thereby defining a float gap 410 within the aperture 450. The float gap 410 allows the float insert 405 to move and facilitates alignment of the cable terminal end 435 and the cable pin 425 with the connector terminal 420. Also, the float insert 405 has a camfered end 415 that facilitates alignment.

Figure 5:
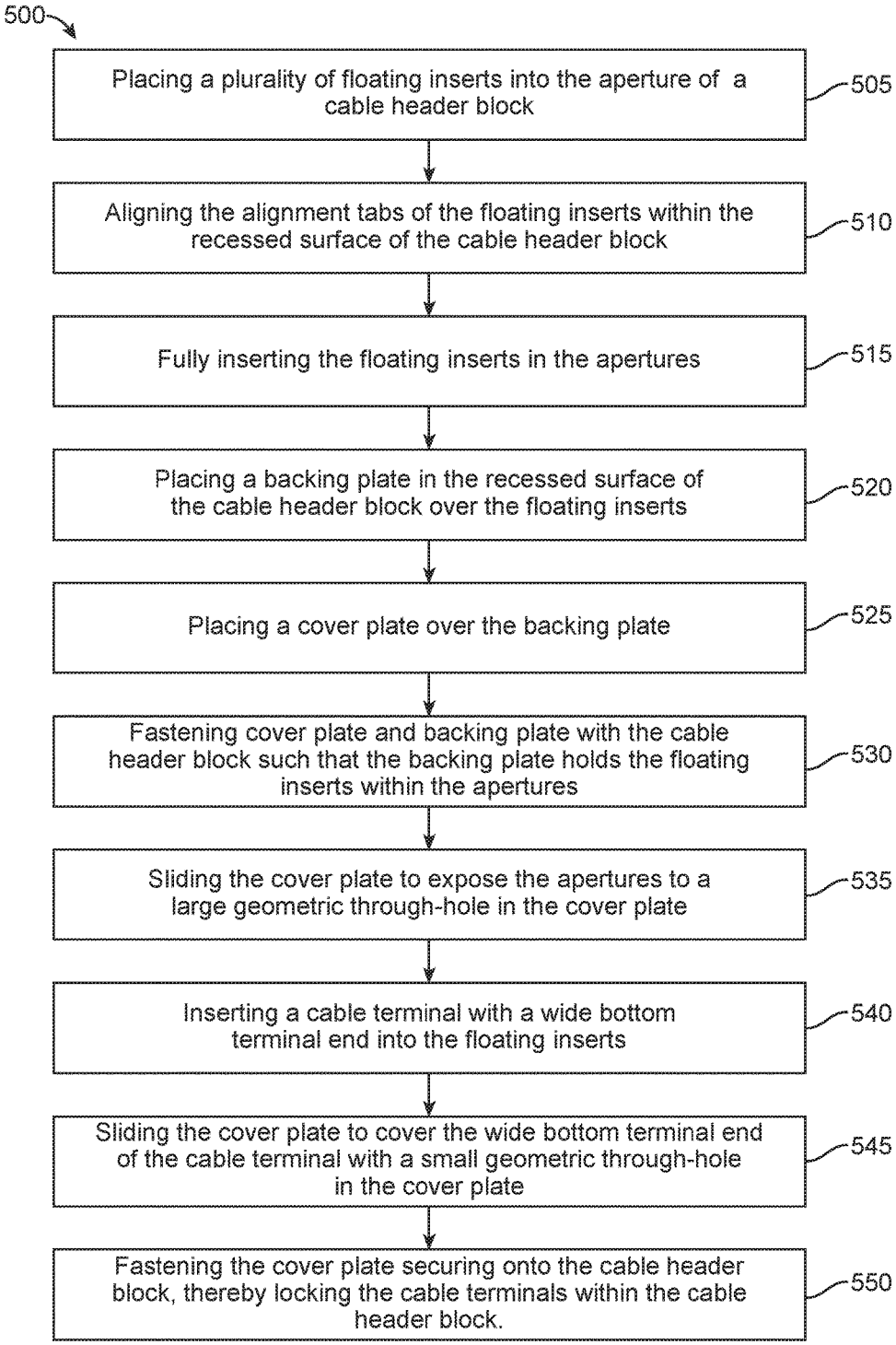
FIG. 5 illustrates a method of assembling a cable header with a plurality of cables and a cover plate.

FIG. 5 illustrates a method 500 of assembling a cable header, connecting a plurality of cables within the cable header, and coupling the cable header with a connector terminal of an electronic component. The method 500 involves placing a plurality of floating inserts into the aperture of a cable header block 505, aligning the alignment tabs of the floating inserts within the recessed surface of the cable header block 510, and then fully inserting the floating inserts in the apertures 515. Next, the method 500 involves placing a backing plate in the recessed surface of the cable header block over the floating inserts 520, placing a cover plate over the backing plate 525, and fastening cover plate and backing plate with the cable header block 530 such that the backing plate holds the floating inserts within the apertures and such that the cover plate can slide over the cable header block. Next, the method 500 involve sliding the cover plate to expose the apertures to a large geometric through-hole in the cover plate 535 and inserting a cable terminal with a wide bottom terminal end into the floating inserts 540. After the cable terminals are inserted into the floating inserts, the method 500 involve sliding the cover plate to cover the wide bottom terminal end of the cable terminal with a small geometric through-hole in the cover plate 545 and fastening the cover plate securing onto the cable header block, thereby locking the cable terminals within the cable header block 550.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that one member of the set or multiple members of the set satisfy the claim.

What is claimed is:

1. An apparatus comprising:

a cable header block with a fastener hole and an aperture pattern of one or more apertures, the aperture pattern configured to substantially match a pattern of one or more connector terminals;

one or more floating inserts, each of the one or more floating inserts configured to fit in one of the one or more apertures of the cable header block; and a cover plate comprising:

at least one slide channel disposed along a linear length through a surface of the cover plate; and a through-hole pattern of one or more through-holes, wherein the through-hole pattern substantially matches the aperture pattern, and wherein each of the through-holes comprise a first geometric shape larger than a cross-section of a cable terminal end that mates with the one or more connector terminals and a second geometric shape adjacent to the first geometric shape in a same direction as the linear length and smaller than the cross-section of the cable terminal end, wherein, the cover plate is coupled to the cable header block and retains the one or more floating inserts within the one or more apertures when a fastener is fastened into the fastener hole of the cable header block through the slide channel of the cover plate, and the cover plate is further configured to substantially align the first geometric shape of the through-holes over the one or more floating inserts when the fastener is in a first position in the slide channel and to substantially align the second geometric shape over the one or more floating inserts when the fastener is in a second position in the slide channel.

2. The apparatus of claim 1, further comprising:

a gap formed between at least a portion of a dimension of the one or more floating inserts and the one or more apertures when the one or more floating inserts are fit into the one of the one or more apertures of the cable header block.

3. The apparatus of claim 1, wherein the cable header block further comprises a surface ridge on an upper top surface perimeter, the surface ridge defining a recessed top surface.

4. The apparatus of claim 3, wherein the one or more floating inserts comprise an alignment tab on a second terminal end, wherein the alignment tab aligns the one or more floating inserts with the surface ridge of the cable header block.

5. The apparatus of claim 3, further comprising:

a guide pin disposed on the recessed top surface, wherein the cover plate further comprises a guide channel disposed along the linear length of the cable header block and disposed through the surface of the cover plate, and wherein the guide pin fits in the guide channel when the cover plate is coupled to the cable header block such that the guide pin traverses a length of the guide channel when the fastener moves between the first position and the second position in the slide channel.

6. The apparatus of claim 3, further comprising:

a backing plate configured to fit within the recessed top surface of the cable header block, the backing plate comprising:

one or more openings substantially matching the aperture pattern of the cable header block; and a backing plate fastener hole substantially matching the fastener hole of the cable header block.

7. The apparatus of claim 1, wherein the cable header block has an additional pair of fastener holes disposed therein, wherein the cover plate has an additional pair of through-holes disposed therein, wherein the additional pair of fastener holes and the additional pair of through-holes are configured to allow a panel mounting fastener to be inserted therethrough for mounting the cable header block to a panel.

8. The apparatus of claim 1, wherein the aperture pattern comprises a top row of one or more apertures and a bottom row of one or more apertures, wherein an aperture boundary for the one or more apertures in the top row respectively overlap with another aperture boundary for the one or more apertures in the bottom row to create one or more overlap regions.

9. The apparatus of claim 8, wherein the one or more floating inserts have a substantially cylindrical outer surface with a chamfered edge on a first terminal end and a cut-away section in a second terminal end, wherein the cut-away section has a cross-sectional shape substantially similar to half the one or more overlap regions.

10. An apparatus comprising:

a cable header block with an aperture pattern of one or more apertures, the aperture pattern configured to substantially match a connector terminal pattern of one or more connector terminals, the aperture pattern including a top aperture with an aperture boundary, a bottom aperture, and a bottom aperture boundary that overlaps with the aperture boundary to create an overlap region; and one or more floating inserts, each of the one or more floating inserts configured to fit in one of the one or more apertures of the cable header block to form a gap between at least a portion of a dimension of the one or more floating inserts and the one or more apertures.

11. The apparatus of claim 10, wherein the cable header block further comprises a surface ridge on an upper top surface perimeter, the surface ridge defining a recessed top surface.

12. The apparatus of claim 11, wherein the one or more floating inserts comprise an alignment tab on a second terminal end, wherein the alignment tab aligns the one or more floating inserts with the surface ridge of the cable header block.

13. The apparatus of claim 11, further comprising:

a backing plate configured to fit within the recessed top surface of the cable header block, the backing plate comprising one or more openings substantially matching the aperture pattern of the cable header block, wherein the backing plate is configured to retain the one or more floating inserts within the one or more apertures of the cable header block when the backing plate is fastened to the cable header block.

14. The apparatus of claim 10, wherein the cable header block has an additional pair of fastener holes disposed through the cable header block, the fastener holes configured to allow a panel mounting fastener to be inserted therethrough for mounting the cable header block to a panel.

15. The apparatus of claim 10, wherein, the aperture pattern comprises a top row of apertures overlapping with a bottom row of apertures, the top aperture is in the top row of apertures, and the bottom aperture is in the bottom row of apertures.

16. The apparatus of claim 10, wherein the one or more floating inserts have a substantially cylindrical outer surface with a chamfered edge on a first terminal end and a cut-away section in a second terminal end, wherein the cut-away section has a cross-sectional shape substantially similar to one half of the overlap region.

17. An apparatus comprising:

a cable header block with a fastener hole and an aperture pattern of one or more apertures, the aperture pattern configured to substantially match a pattern of one or more connector terminals; and a cover plate comprising:

at least one slide channel disposed along a linear length through surface of the cover plate; and a through-hole pattern of one or more through-holes, wherein the through-hole pattern substantially matches the aperture pattern, and wherein each of the through-holes comprise a first geometric shape larger than a cross-section of cable terminal end that mates with the one or more connector terminals and a second geometric shape adjacent to the first geometric shape in a same direction as the linear length and smaller than the cross-section of the cable terminal end, wherein, the cover plate is coupled to the cable header block when a fastener is fastened into the fastener hole of the cable header block through the slide channel of the cover plate, and the cover plate is further configured to substantially align the first geometric shape of the through-holes over the one or more apertures when the fastener is in a first position in the slide channel and to substantially align the second geometric shape over the one or more apertures when the fastener is in a second position in the slide channel.

18. The apparatus of claim 17, wherein the cable header block further comprises a surface ridge on an outer top surface perimeter, the surface ridge defining a recessed top surface, the apparatus further comprising a guide pin disposed on the recessed top surface, wherein the cover plate further comprises a guide channel disposed along the linear length of the cable header block and disposed through the surface of the cover plate, and wherein the guide pin fits in the guide channel when the cover plate is coupled to the cable header block such that the guide pin traverses a length of the guide channel when the fastener moves between the first position and the second position in the slide channel.

19. The apparatus of claim 18, further comprising:

a backing plate configured to fit within the recessed top surface of the cable header block, the backing plate comprising:

one or more openings substantially matching the aperture pattern of the cable header block; and a backing plate fastener hole substantially matching the fastener hole of the cable header block.

20. The apparatus of claim 18, wherein the aperture pattern comprises a top row of one or more apertures and a bottom row of one or more apertures, wherein an aperture boundary for the one or more apertures in the top row respectively overlap with another aperture boundary for the one or more apertures in the bottom row.

* * * * *